US005554495A

United States Patent [19]

Tsuji

[11] Patent Number: 5,554,495

[45] Date of Patent: Sep. 10, 1996

[54] SILVER HALIDE PHOTOGRAPHIC LIGHT SENSITIVE MATERIAL CONTAINING ANTISTATIC LAYER

[75] Inventor: Nobuaki Tsuji, Hino, Japan

[73] Assignee: Konica Corporation, Japan

[21] Appl. No.: 333,141

[22] Filed: Nov. 1, 1994

[30] Foreign Application Priority Data

Nov. 9, 1993 [JP] Japan ..... 5-279923

[51] Int. Cl.[6] ..... G03C 1/85

[52] U.S. Cl. ..... 430/530; 430/527

[58] Field of Search ..... 430/527, 530

[56] References Cited

U.S. PATENT DOCUMENTS 4,683,193 7/1987 Ihama et al. ..... 430/570

FOREIGN PATENT DOCUMENTS 491176 6/1992 European Pat. Off. .

3246826 6/1983 Germany .

2115569 9/1983 United Kingdom .

*Primary Examiner*—Charles L. Bowers, Jr.

*Assistant Examiner*—Christopher G. Young

*Attorney, Agent, or Firm*—Jordan B. Bierman; Bierman and Muserlian

[57] ABSTRACT

A silver halide photographic light-sensitive material is provided, comprising a support having thereon an antistatic layer and further having thereon a silver halide emulsion layer, wherein the antistatic layer comprises a water-soluble conductive polymer and a hydrophobic polymer, the layer having been hardened with a hardener, or the antistatic layer comprises conductive metal oxide particles containing at least one metal selected from Zn, Ti, Sn, Al, In, Si, Mg, Ba, Mo, W and V; and the silver halide emulsion is spectrally sensitized by adding thereto a substantially water-insoluble spectral-sensitizing dye in the form of a dispersion of solid particles dispersed in an aqueous medium substantially free from an organic solvent and a surfactant.

6 Claims, 1 Drawing Sheet

SILVER HALIDE PHOTOGRAPHIC LIGHT SENSITIVE MATERIAL CONTAINING ANTISTATIC LAYER

FIELD OF THE INVENTION

The present invention relates to a silver halide, more particularly to a silver halide photographic light-sensitive material improved in development uniformity, when subjected to rapid-processing, without deteriration of antistatic ability and a processing method thereof.

BACKGROUND OF THE INVENTION

Recently, a rapid progress has been made in speed-up of processing and lowering of replenishing rate. With the progrss thereof, a problems such as uneven development occurs. There has been known a means for preventing from occurrence of uneven development by accelerating a developing speed using a photographic material with an increased swelling degree. However, it was found that this method resulted in deterioration in drying due to an increase of carried-in water content.

In order to solve uneven development, an addition of various surfactants has been made studied but a sufficient effect has not been achieved. The present inventor has attempted to an addition of a nonionic polyethylene-type surfactant for the purpose of preventing from charging in a photographic material, however, uneven development was not solved in the case when subjected to rapid-processing.

SUMMARY OF THE INVENTION

The object of the present invention is to provide a silver halide photographic light-sensitive material capable of prohibiting occurrence of uneven development without deteriorating an antistatic property.

The above object of the present invention is achieved by a silver halide photographic light-sensitive material comprising a support having thereon an antistatic layer containing a water-soluble conductive polymer and a hydrophobic polymer and having been hardened with a hardener, or an antistativ layer containing conductive metal oxide particles composed of at least one selected from Zn, Ti, Al, In, Si, Mg, Ba, Mo, W and V; and further having thereon a silver halide emulsion layer containing a silver halide emulsion, which is spectrally sensitized by adding a spectral sensitizing dye in the form of a solid particle dispersion prepared in such a manner that a substantially water-insoluble spectral sensitizing dye is added, in an amount in excess of the solubility thereof, in an aqueous medium substantially free from an organic solvent and a surfactant and dispersed therein to form a dispersion of solid particles having a size of not larger than 1 μm; and a method of processing the silver halide photographic light-sensitive material by an automatic processor in a total processing time (in other words, dry to dry time) of 20 to 60 seconds.

Explanation of Numerals

Figure 1:
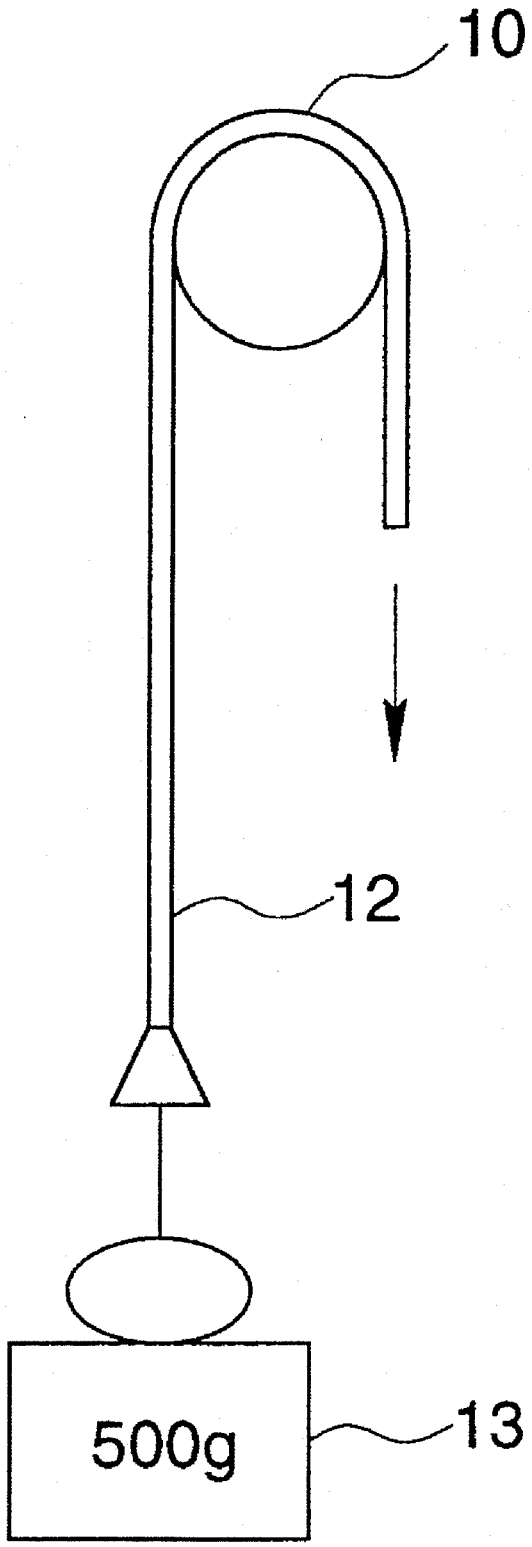
FIG. 1 shows a shematic view of an appratus for static mark test.

10: Neoprene rubber bar, 12: Sample, 13: Weight

DETAILED DESCRIPTION OF THE INVENTION

A technique of dispersingf mechanically an organic dyestuff in aqueous medium has be known in Japanese Patent Open to Public Inspection (O.P.I.) No. 3-288842/1991. This technique is a means to immobilize the dye in a photographic material and merely a dispersion-adding technique. In contrast with this, the present invention is directed to have a spectral sensitizing dye adsorbed uniformly and effectively on the surface of a silver halide grain, therefore it is different in objects and effects thereof from the above-described technique for dispersing and adding thereof.

In the invention, an organic solvent means a solvent containing carbon atom(s) which is liquid at room temperature. As a sovent for a spectral sensitizing dye, there have been known water-miscible organic solvents such as alcohols, ketones, niriles, and alkoxyalcohols. Examples thereof include methanol, ethanol, n-propylalcohol, isopropylalcohol, ethleneglycol, propyleneglycol, 1,3-propanediol, acetone, acetinirile, 2-methoxyethanol and 2-ethoxyethanol.

In the present invention, these organic solvents are not substantially contained. Thus, in the present invention, the terms "substantially free from an organic solvent" means that the organic solvent described above is in a content of not more than 10% by weight, preferably 3%, more preferably 0.5% There have been known surfactant of a anionic type surfactant, a cationic type surfactant, a nonionic type surfactant and a betaine type surfactant. These surfactants have been employed as a dispersing agent for a spectral sensitizing dye. In the present invention, however, these surfactants are not substantially contained. Thus, in the present invention, the terms "substantially free from a surfactant" means that the surfactant described above is in a content of not more than 0.10% by weight, preferably 0.05%

An aqueous medium substantially free from an organic solvent and surfactant of the present invention is water containing an impurity in an extent of exerting no harmful effect, preferably, it is deionized water.

In order to disperse a spectral sensitizing dye in an aqueous medium in the state of containing substantially no organic solvent or surfactant, various dispersion method can be effectively employed. Stated specifically, a high-speed stirrer, a ball mill, a sand mill, a colloid mill, an attritor, an ultrasonic dispersion machine may be used. In the present invention, a high-speed stirrer is preferred.

As a high-speed stirrer type dispersing machine there can be exemplified by a dispersing machine comprised of dissolver fitted with a impeller.

The high-speed stirrer type dispersing machine may also be of the type having a dissolver comprising a vertical shaft to which a plurality of impellers are fitted or a multi-shaft dissolver provided with a plurality of vertical shafts. Besides the one comprised of the dissolver alone, a high-speed sirring dipersion machine having an anchor blade is more preferable. To specifically describe an example of operation, water is put in a temperature-controllable tank and thereafter a powder of spectral sensitizing dye is added in a given amount, followed by stirring using the high-speed stirrer for a given time under temperature control, and then pulverization and dispersion. There are no particular limitations on the pH and temperature when the spectral sensitizing dye is mechanically dispersed. If, however, the dispersion is carried out at a low temperature for a long time, no desired particle size achieved, or if it is caried out at a high temperature, reagglomeration or decomposition may occur to make it impossible to obtain the desired photographic performance. Also, when the temperature is raised, the viscosity of a solution may decrease to cause a great loweringof solid-body pulverization and dispersion efficiency. On account of these problems, the dispersion may be preferably carried out at a temperature of 15° to 50° C. With regard to revolution number of the stirring when the dispersion is carried out, stirring at a low revolution number may take a long time for achieving the desired particle size and stirring at an excessively high revolution number may cause inclusion of bubbles to make dispersion efficiency lower. Hence, the stirring may preferably be carried out at 1,000 to 6,000 r.p.m.

The dispersion referred to in the present invention referes to a solid particle dispersion (suspension) of a spectral sensitizing dye. The dispersion preferably contains the spectral sensitizing dye in an amount of 0.2 to 5.0 % by weight. Solid particles of the dispersion has preferably an average size of 1 μm or less, more preferably, 0.01 to 1.0 μm.

The spectral sensitizing dye dispersion prepared according to the present invention may be directly added to the silver halide emulsion, or may be added after its appropriate dilution. When diluted, water is used as a diluent.

In the present invention, the terms "substantially water-insoluble" means that a solubility of the spectral-sensitizing dye in water at 27° C. is within a range of $2\times10^{-4}$ to $4\times10^{-2}$, preferably $1\times10^{-3}$ to $4\times10^{-2}$ mol per liter.

Thus, if a solubility is lower than the above-mentioned range, dispersed particle sizes become larger remarkably so as to be nonuniform. It was, therefore, found out that precipitates are produced in a dispersion after dispersing, and that an adsorption of the dye onto silver halide was hindered when a dispersion thereof was added to a silver halide emulsion.

If a solubility is higher than the range, it was found of the studies by the present inventors that a dispersion was hindered by unnecessarily increasing the viscosity of a solution and then by taking babbles therein, so that the dispersion could not be performed with a further higher solubility.

In the present invention, the solubility of a spectral sensitizing dye in water was measured according to the following method.

30 ml of deionized water was poured into a 50 ml-Erlenmeyer flask, a dye was added thereto in an amount sufficient to remain undissolved under visual observation, and then the mixture was stirred with a magnetic stirrer for 10 minutes while kept at 27° C. in a thermostatic chamber. The resultant suspension was filtered with a Filter Paper No.2 (Toyo Filter Co., Ltd.), the filtrate was filtered with a disposable filter (Toso Co., Ltd.), the filtrate was diluted properly and subjected to mesurement of absorbance using a U-3410 spectrophotometer (Hitachi Co., Ltd.). From the measurement results, the concentration of the solution was determined according to Lambert-Beer's law given by the following equation:

$D=\epsilon lc$ (D: absorbance, $\epsilon$ spectral absorption coefficient, l: length of absorbance measuring cell, c: concentration), and then the solubilty was determined.

A spectral sensitizing dye used in the invention is that which undegoes electron transfer toward silver halide and resultingly contributes to the sensitization of silver halide when photo-excited in a state of being adsorbed on silver halide grains, therefore, a organic dye is not included in the invention. Spectral sensitizing dyes of the invention may have any chemical structure as long as their solubility in water is in a range of $2\times10^{-4}$ to $4\times10^{-2}$ mol/liter and are preferably cyanine dyes. The cyanine dye may have the following formula (I).

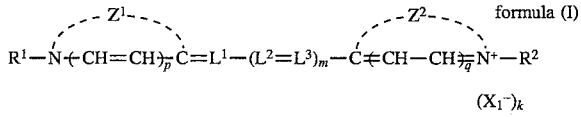

wherein $Z^1$ and $Z^2$ independently represent an nonmetallic atom group necessary for forming a 5- or 6-membered ring; $R^1$ and $R^2$are independently a substituted or unsubstituted alkyl group; $L^1$, $L^2$ and $L^3$ are independently a substituted or unsubstituted methine group; p and q is 0 or 1; m is 0, 1, 2 or 3; X represents an anion; and k is 0 or 1. More preferably, the cyanine dye is one having a hydrophilic group such as $—SO_3H$ or —COOH.

Examples are given below, wherein the solubility thereof in water is also shown in terms of mol per liter of water at 27° C.

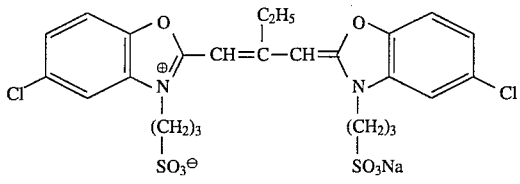

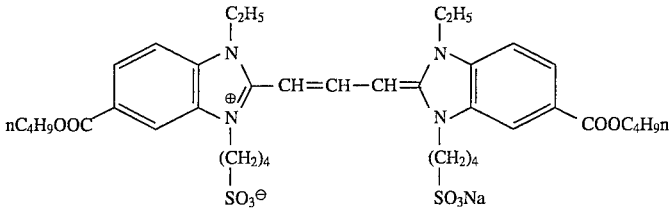

-continued

I-3

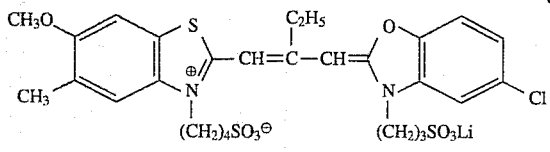

$7.6 \times 10^{-3}$ (mol/l)

I-4

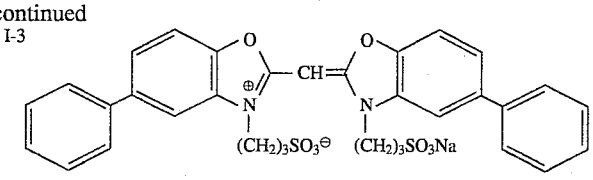

$2.8 \times 10^{-4}$ (mol/l)

I-5

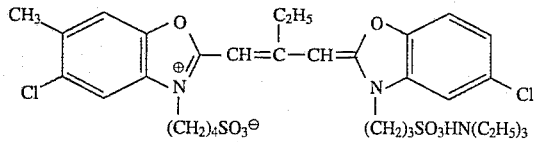

$7.4 \times 10^{-3}$ (mol/l)

I-6

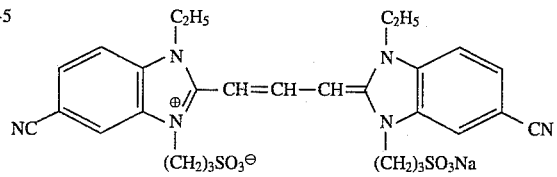

$4 \times 10^{-3}$ (mol/l)

I-7

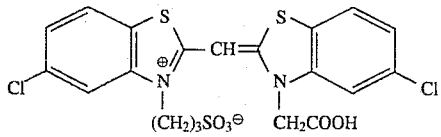

$6 \times 10^{-3}$ (mol/l)

I-8

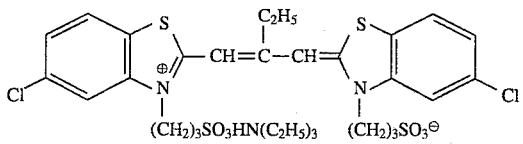

$2.3 \times 10^{-3}$ (mol/l)

I-9

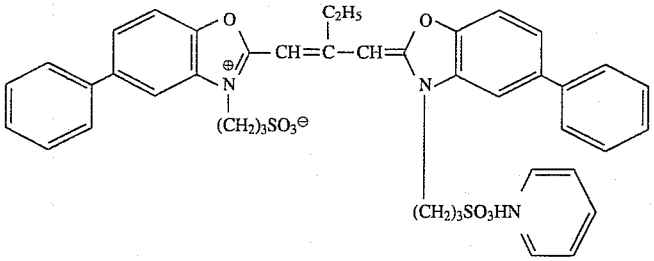

$2.6 \times 10^{-4}$ (mol/l)

I-10

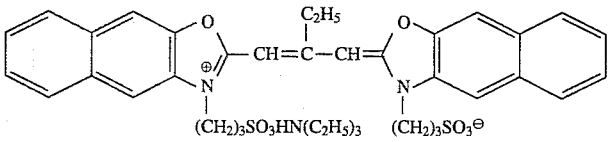

$5.9 \times 10^{-4}$ (mol/l)

I-11

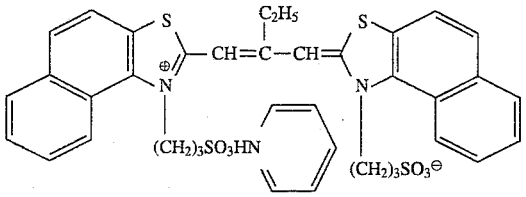

$5.9 \times 10^{-4}$ (mol/l)

I-12

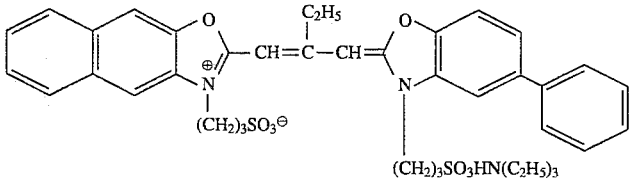

$5.9 \times 10^{-4}$ (mol/l)

A dispersion of a spectral sensitizing dye prepared in the present invention may be added directly to a silver halide emulsion or added dilutedly thereto, in which water is used for dilution. An addition amount is the amount exceeding the solubility of the spectral sensitizing dye, and preferably 1 to 1000 mg, more preferably, 5 to 500 mg per mol of silver halide. When added, two or more kinds of dyes may be used in combination. Two or more dyes may be added mixedly at the same time or separately at different times. The dyes may be added gradually in proportion to the surface area of growing grains A silver halide emulsion of the invention may be chemical-sensitized. As a chemical-sensitization, a sulfur sensitization, reduction sensitization, noble metal sensitization or combination thereof may be employed. Examples of chemical sensitizers include a sulfur sensitizer such as an allylthiocarbamide, thiourea, thiosulfate, thioether or cystein; a noble metal sensitizer such as potassium chloroaurate, aurous thiosulfate or potassium chloropalladate; and a reduction sensitizer such as tin chloride, phenylhydrazine or reductone.

A silver halide photographic light sensitive material of the invention may comprise a silver halide emulsion layer,or a hydrophilic colloidal layer such as a protective layer, an interlayer, a filter layer, a ultra-violet ray absorbing layer, an antistatic layer, a antihalation layer or a backing layer.

Gelatin and various synthetic polymers can be used, as a binder or protective colloid, for these hydrophilic colloidal layers.

Besides a lime-processed gelatin, there can be used an acid-processed gelatin and a gelatin derivative as a gelatin. In addition to the gelatin, as examples of synthetic polymers, there can be cited a cellulose derivative such as hydroxycellulose, polymers such as polyvinyl alcohol, polyvinyl alcohol partially acetal, poly-N-vinyl pyrrolidone, polyacrylate and polyacrylamide, and a copolymer thereof.

Compounds used in these precesses are referred to those described Research Disclosure (RD) Nos. 17643,18716 and 308119 (October, 1989). Kinds of compounds and sections described in these Research disclosures are give as below.

| Additives | RD-18716 | | RD-30819 | RD-308119 | |
|---|---|---|---|---|---|
| RD-17643 | Page | Sect. | Page | Page | Sect. |
| Desensitizing dye | 23 | IV | | 998 | B |
| Dye | 25–26 | VIII | 649–650 | 1003 | VIII |
| Developing accelerator | 24 | XXI | 648 rt. | | |
| Fog inhibitor Stabilizer | 24 | IV | 649 rt. | 1006–7 | VI |
| Brightener | 24 | V | | 998 | V |
| Hardener | 26 | X | 651 lt. | 1004–5 | X |
| Surfactant | 26–27 | XI | 650 rt. | 1005–6 | XI |
| Plasicizer | 27 | XII | 650 rt. | 1006 | XII |
| Sliding agent | 27 | XII | | | |
| Matting agent | 28 | XVI | 650 rt. | 1008–9 | XVI |
| Binder | 26 | XXII | | 1003–4 | IX |
| Support | 28 | XVII | | 1009 | XVII |

A support used in a silver halide photographic light sensitive material of the present invention is referred to the above-mentiond Research Disclosures. An appropriate support is a plastic film. The surface of the support may be provided with a subbing layer so as to improve adhesion property, or subjected to corona dischare or ultra-violet ray irradiation.

Processing steps of a silver halide photographic light sensitive material relating to the invention is preferably completed within a period of 90 seconds or less, when processed with an automatic processor including the steps of developing, fixing, washing (or stabilizing) and drying.

Thus, a period of time from a time when a top of the photographic material is dipped into a developer to a time when the top comes out of a drying zone (so-called dry to dry time) is preferably within 60 seconds, more preferably within 45 seconds.

A fixing time and a temperature is preferably 6 to 20 seconds at 20° to 50° C., more preferably 6 to 15 seconds at 30° to 40° C.

A developing time with a developer relating the present invention is 5 to 45 seconds, preferably 8 to 30 seconds. A developing time is preferably 25° to 50° C., more preferably 30° to 40° C.

A drying zone having a heating means by blowing heated air of 35° to 100° C., preferably 40° to 80° C. or by exposing to a far-infrared ray may be builtd in an automatic processor.

The automatic processor may be provided with a device capable of supplying water or a acidic rinsing solution having no fixabilty between developing and fixing,or between fixing and washing. The processor may be provided with an equipment capable of preparing a developer or fixer solution.

A photographic material of the present invention can be processed with a processing solution described in Research Disclosures RD-17643, XX–XXI on pages 29–30 and RD-308119, XX–XXI on pages 1011–1012. As a developer for black and white photographic processing, can be employed dihyroxybenzenes such as hydroquinone, 3-pyrazolidones such as 1-phenyl-3-pyrazolidone, aminophenol such as N-methyl-p-aminophenol or a combination thereof. In addition, the developer may contain, according to a need, a preservative, alkaline agent, pH buffer, antifoggant, hardener, development accelerating agent, surfactant, deformer, toning agent, water-softening agent, solubilizing aids or thickener, as conventionally known in the art.

Furthermore, a developer replenishing amount used in the process of the invention is preferably not more than 300 $ml/m^2$.

A fixing agent such as a thiosulfate or thiocyanate can be used for a fixing solution. In addition thereto, a water-soluble aluminium salt such as aluminium sulfate or potassium alum may be contained. Besides, a preservative, pH-adjusting agent to water-softening agent may be contained.

An antistatic layer preferably used in the present invention is as follows.

(1) An antistatic layer containing a water soluble electrically-conducting polymer and a hydrophobic polymer and the layer having been hardened by adding thereto a hardener, which is referred to JP O.P.I. No.6-130527.

Examples of water-soluble conductive polymers are given as follows.

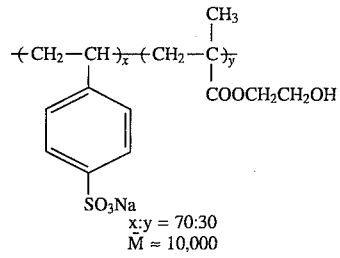

P1

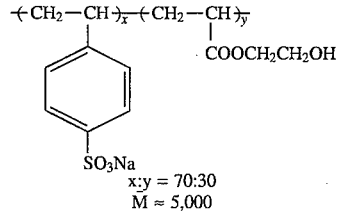

P2

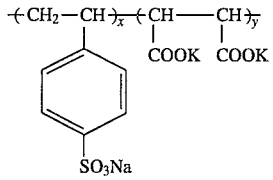

P3

-continued
x:y = 50:50
$\bar{M}$ ≈ 6,000
P4
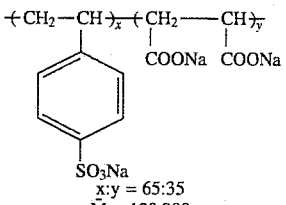
x:y = 65:35
$\bar{M}$ ≈ 120,000
P5
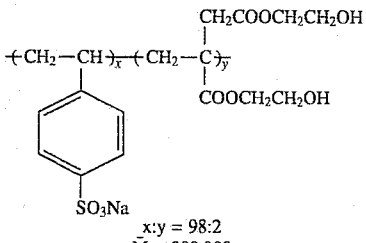
x:y = 98:2
$\bar{M}$ ≈ 200,000
P6
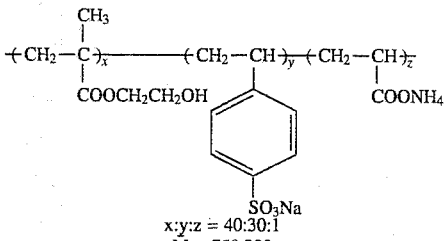
x:y:z = 40:30:1
$\bar{M}$ ≈ 750,000
P7
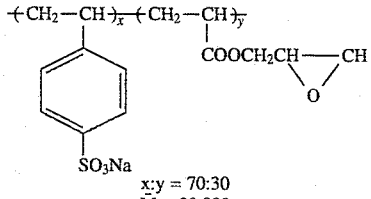
x:y = 70:30
$\bar{M}$ ≈ 20,000
P8
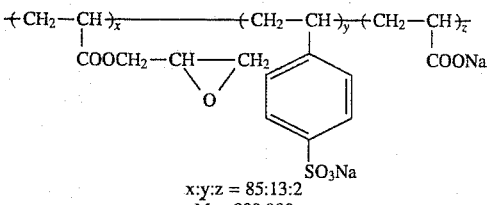
x:y:z = 85:13:2
$\bar{M}$ ≈ 800,000
P9
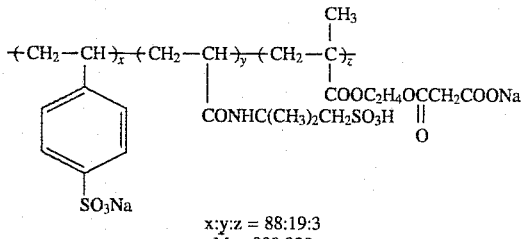
x:y:z = 88:19:3
$\bar{M}$ ≈ 900,000
-continued
P10
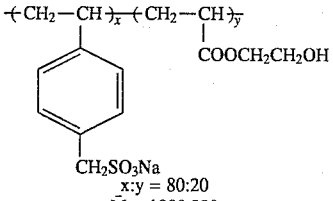
x:y = 80:20
$\bar{M}$ ≈ 1000,000
P11
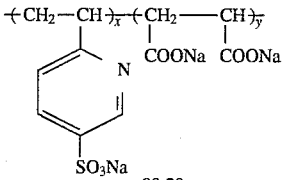
x:y = 80:20
$\bar{M}$ ≈ 10,000
P12
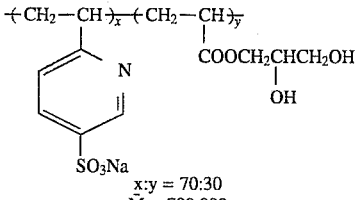
x:y = 70:30
$\bar{M}$ ≈ 700,000
P13
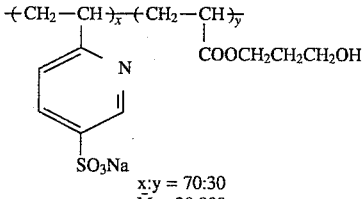
x:y = 70:30
$\bar{M}$ ≈ 20,000
P14
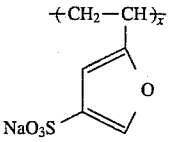
$\bar{M}$ ≈ 200,000
P15
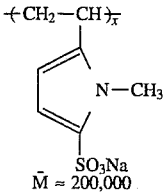
$\bar{M}$ ≈ 200,000
P16
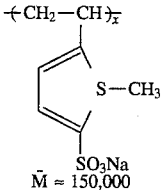
$\bar{M}$ ≈ 150,000
P17
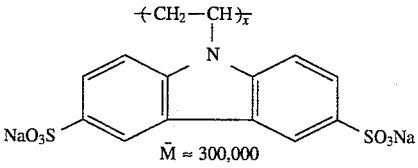
$\bar{M}$ ≈ 300,000

-continued
P18
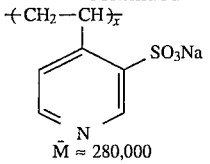
$\bar{M} \approx 280{,}000$
P19
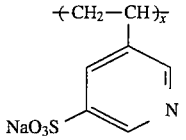
$\bar{M} \approx 450{,}000$
P20
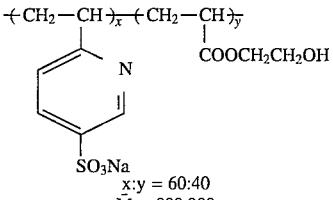
x:y = 60:40
$\bar{M} \approx 800{,}000$
P21
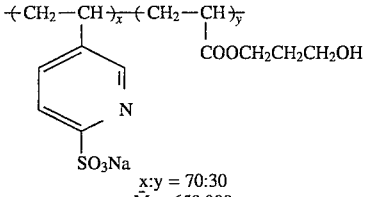
x:y = 70:30
$\bar{M} \approx 650{,}000$
P22
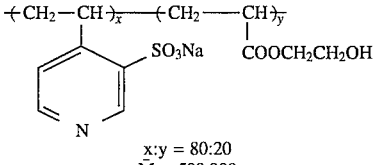
x:y = 80:20
$\bar{M} \approx 500{,}000$
P23
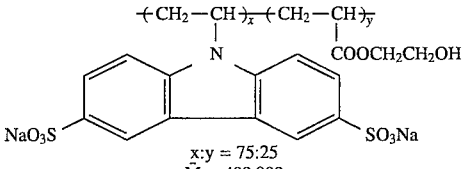
x:y = 75:25
$\bar{M} \approx 400{,}000$
P24
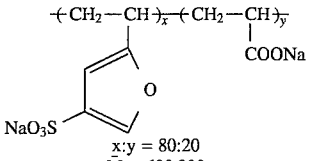
x:y = 80:20
$\bar{M} \approx 600{,}000$
P25
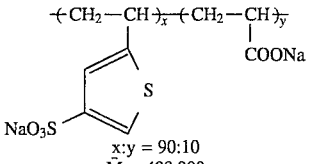
x:y = 90:10
$\bar{M} \approx 400{,}000$
-continued
P26
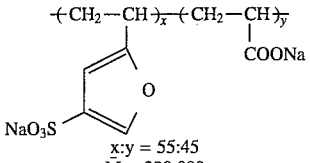
x:y = 55:45
$\bar{M} \approx 320{,}000$
P27
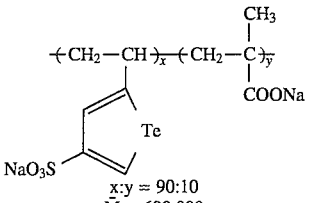
x:y = 90:10
$\bar{M} \approx 600{,}000$
P28
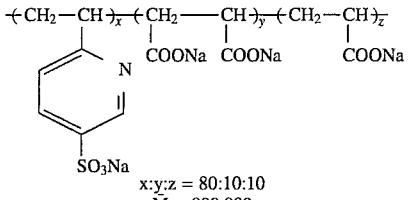
x:y:z = 80:10:10
$\bar{M} \approx 800{,}000$
P29
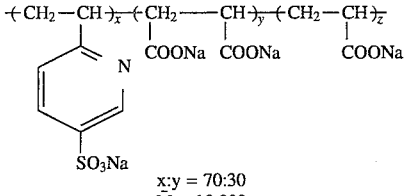
x:y = 70:30
$\bar{M} \approx 10{,}000$
P30
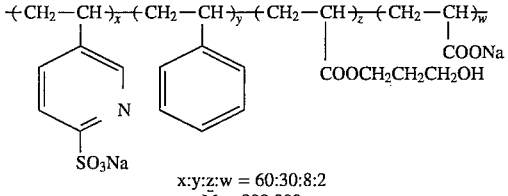
x:y:z:w = 60:30:8:2
$\bar{M} \approx 800{,}000$
P31
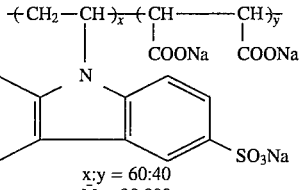
x:y = 60:40
$\bar{M} \approx 30{,}000$
P32
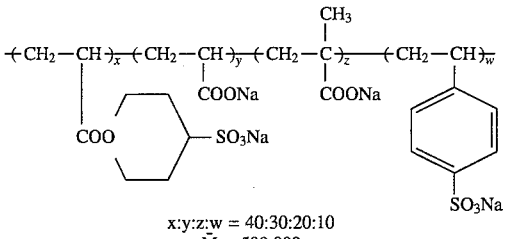
x:y:z:w = 40:30:20:10
$\bar{M} \approx 500{,}000$ -continued

P33

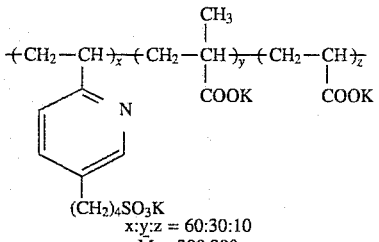

x:y:z = 60:30:10
$\overline{M}$ ≈ 300,000

P34

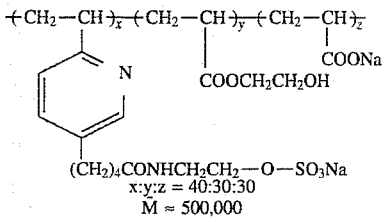

x:y:z = 40:30:30
$\overline{M}$ ≈ 500,000

P35

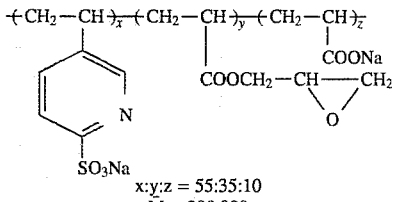

x:y:z = 55:35:10
$\overline{M}$ ≈ 300,000

-continued

P36

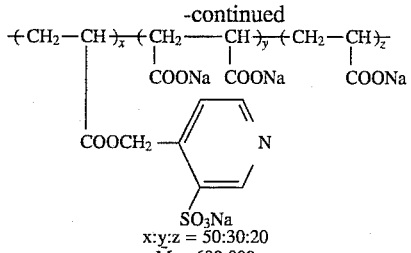

x:y:z = 50:30:20
$\overline{M}$ ≈ 600,000

P37

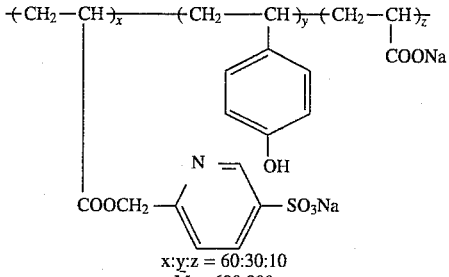

x:y:z = 60:30:10
$\overline{M}$ ≈ 600,000

In the above polymers, $\overline{M}$ represents a weight-average molecular weight. The water-soluble conductive polymer of the invention is contained in an amount of 0.001 to 10 g, preferably 0.05 to 5 g per $m^2$ of a photographic material.

Examples of hydrophobic polymers are given below.

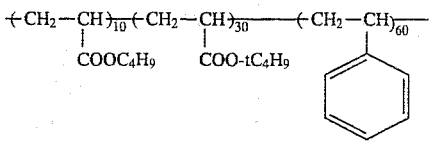

$\overline{M}$ = 100,000

HP1

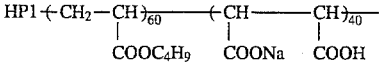

HP2

$\overline{M}$ = 200,000

HP3

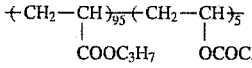

$\overline{M}$ = 300,000

HP4

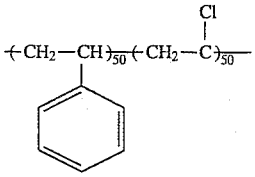

HP5

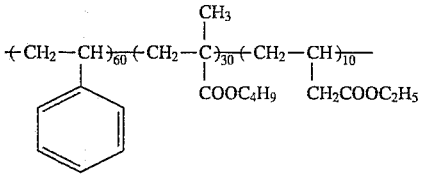

$\overline{M}$ = 300,000

HP6

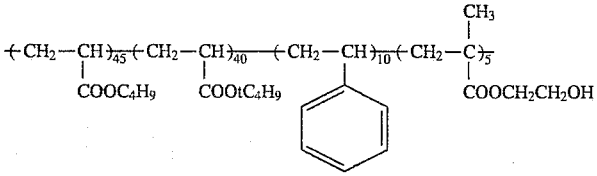

$\overline{M}$ = 500,000

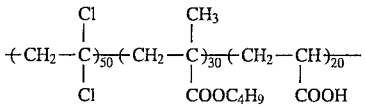

$\overline{M}$ = 200,000

-continued

HP7 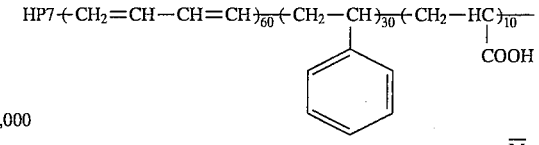 HP8

$\overline{M}$ = 600,000

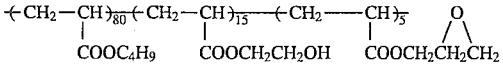 HP9

$\overline{M}$ = 150,000

In the above polymers, M represents a weight-average molecular weight. The hydrophobic polymer is contained in an amount of 5 to 60%, preferably 10 to 40% of the water-soluble conductive polymer based on weight.

Examples of a hardener preferably used in the present invention are given below.

Aziridines represented by the following formula,

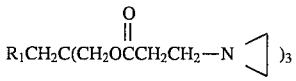

wherein $R_1$ is a hydrogen atom, an alkyl group having 20 or less carbon atoms, an aryl group, hydroxy, or halogen atom; $R_2$ is a hydrogen atom or an alkyl group having 10 or less carbon atoms.

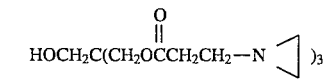 AH1

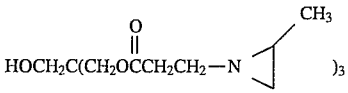 AH2

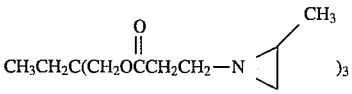 AH3

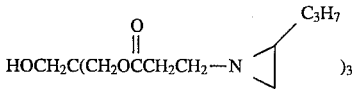 AH4

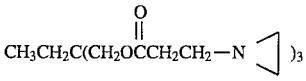 AH5

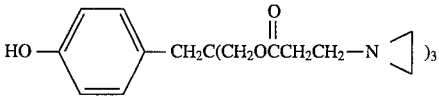 AH6

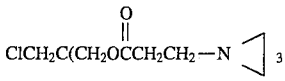 AH7

α-Cyanoacrylates:

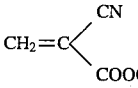 CH1

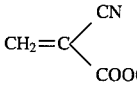 CH2

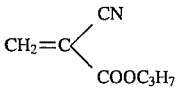 CH3

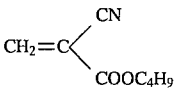 CH4

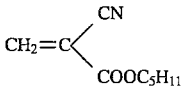 CH5

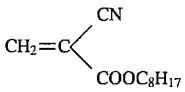 CH6

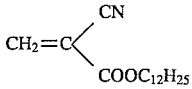 CH7

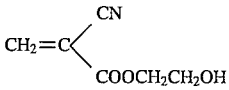 CH8

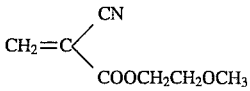 CH9

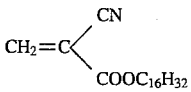 CH10

-continued

Epoxides:

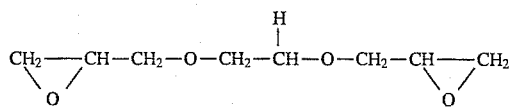

EH1

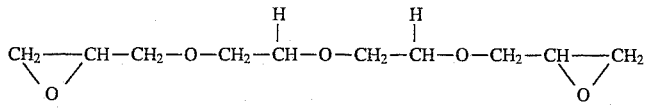

EH2

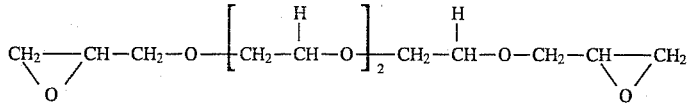

EH3

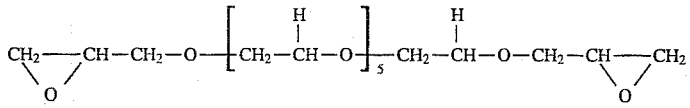

EH4

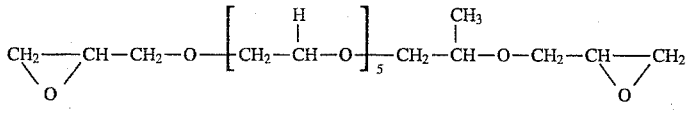

EH5

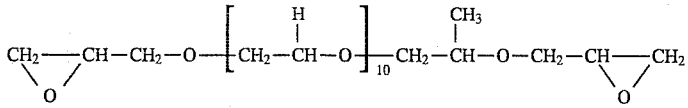

EH6

The hardener as described above is dissolved in water or a organic solvent such as an alcohol or aceton to be added as such or with the use of surfactant. The hardener is added in an amount of 1 to 1000 mg/m$^2$ of a photographic material.

(2) An antistatic layer comprising a metal oxide containing, as a metal, at least one selected from Zn, Ti, Sn, Al, In, Si, Mg, Ba, Mo, W, and V is referred to JP O.P.I. No. 4-234756. Examples of the metal oxide include ZnO, $TiO_2$, $SnO_2$, $Al_2O_3$, $In_2O_3$, $SiO_2$, MgO, BaO, $MOO_3$, $V_2O_5$ and complex thereof. Among them, ZnO, $TiO_2$ and $SnO_2$ are preferable. The metal oxide is contained in an amount of 0.0009 to 0.5 g/m$^2$, preferably, 0.0012 to 0.3 g/m$^2$ of photographic material.

In the embodiment of the present invention, various techniques which have used in the photographic technology can be applied.

EXAMPLE 1

Preparation of tabular seed emulsion

A tabular,hexagonal crystal seed emulsion was prepared in the following manner.

| | |
|---|---|
| Solution A | |
| Ossein gelatin | 60 2 g |
| Distilled water | 20.0 l |
| Polyisopropylene-polyethylene-disuccinate sodium salt (10% ethanol solution) | 5.6 ml |
| KBr | 26.8 g |
| 10% $H_2SO_4$ | 144 ml. |
| Solution B | |
| Silver nitrate | 1487.5 g |
| Distilled water to make | 3500 ml |
| Solution C | |
| KBr | 1029 g |
| KI | 29.3 g |

-continued

| | |
|---|---|
| Distilled water | 3500 ml |
| Solution D | |
| 1.75 N. KBr solution, an amount necessary for controlling a Ag-potential | |

64.1 ml of each of Solutions B and C was simultaneously added to solution A at a temperature of 35° C. by a double jet method over a period of two minutes, while stirred by a mixing stirrer as disclosed in JP Examined Nos. 58-58288 and 58-58289 so that nucleus grains were formed.

After completing the addition of solutions B and C, an temperature of a mother liquor was increased to 60° C. by taking 60 minutes and then remaining solutions of A and B were added thereto at a flow rate of 68.5 ml/min. over a period of 50 minutes, while a silver potential which was monitored by a silver ion selection electrode with reference to a saturated silver-silver chloride electrode was controlled to be +6 mV using Solution D. After completing the addition, pH of the resulting emulsion was adjusted to 6 using a 3% KOH solution and subjected to desalinization-washing to obtain a seed emulsiom EM-A. Thus prepared seed emulsion EM-A comprised haxagonal tabular gains having an maximun adjacent edge ratio and accounting for 90% of the total projected area, which were proved to have an average thickness of 0.07 μm and an average size (circle-equivalent diameter) of 0.5 μm by the observation with a electron microscope.

Preparation of monodispers twinned crystal grain emulsion

A monodispersed, twinned crystal silver iodobromide emulsion containing 1.5 mol% iodide on the average of the invention was prepared using the following solutions.

| | |
|---|---|
| Solution A1 | |
| Ossein gelatin | 29.4 g |
| Polyisopropylene-polyethylene-di-succinate sodium salt (10% ethanol solution) | 2.5 ml |
| Seed emulsion EM-A | 0.588 mol equivalent |
| Distilled water to make | 4800 ml |
| Solution B1 | |
| Silver nitrate | 1487.5 g |
| Distilled water to make | 2360 ml |
| Solution C1 | |
| KBr | 968 g |
| KI | 20.6 g |
| Distilled water | 2360 ml |
| Solution D1 | |
| 1.75 N. KBr solution, an amount necessary for controlling a Ag-potential | |

Solutions of B1 and C1 were simultaneously added into Solution A1 at 60° C. by a double jet method using a mixing stirrer disclosed in JP Examined Nos. 58-58288 and 58-58289. During addition thereof, a silver potential of the mother liquor was controlled to be +25 mV using Solution D1.

After completing the addition, the resulting emulsion was subjected to precipitating desalinization to remove salts in excess using an aqueous solutions of each Demol (produced by Kao-Atlas) and magnesium sulfate, and then 2500 ml of gelatin solution containing 92.2 g of gelatin was added thereto to redisperse the emulsion.

Thus prepared emulsion contains 1.53 mol% iodide on the average, which has an average grain size of 1.05 μm in circle-equivalent diameter of projected image of the grain and an average thickness of 0.25 μm; and 90% of the projected area of the total grains have a ratio of grain diameter to thickness of 2 or more and a ratio of a standard deviation of grain diameter/an average diameter of 0.22.

To the emulsion EM-1, were added spectral sensitizing dyes I-1 and I-2 which were dispersed according to the following manners D-1 to 4, in an amount as shown in Table 1. The resulting emulsions were each chemically sensitized by adding $2.4\times10^3$ mol/mol Ag of ammonium thicyanate and optimal amounts of a chloroaurate and sodium thiosulfate, and thereafter was stabilized by adding $2\times10^{-2}$ mol of 4-hydroxy-6-methyl- 1,3,3*a*, 7-tetrazaindene. The sensitizing dyes were dispersed using a high speed stirring type disperser.

D-1:

The sensitizing dyes I-1 and I-2 (9.87 g: 0.13 g) were dissolved in methanol at 27° C. to obtain a dye methanol solution.

D-2:

The sensitizing dyes I-1 and I-2 (9.87 g: 0.13 g) were added to a mixed solution of 4.9 g of methanol and 485.1 g of water which was previously adjusted to a temperature of 27° C. and then the mixture was stirred with a high speed stirrer (Dissolver) at 3,500 rpm over a period of 30 to 120 minutes to obtain a spectral sensitizing dye dispersion.

D-3:

The sensitizing dyes I-1 and I-2 (9.87 g: 0.13 g) were added to 490 g of an aqueous solution containing 0.1% triisopropylnaphthalene sulfonic acid which was previously adjusted to a temperature of 27° C. and then the mixture was stirred with a high speed stirrer (Dissolver) at 3,500 rpm over a period of 30 to 120 minutes to obtain a spectral sensitizing dye dispersion.

D-4:

The sensitizing dyes I-1 and I-2 (9.87 g: 0.13 g) were added to 490 g of water which was previously adjusted to a temperature of 27° C. and then the mixture was stirred with a high speed stirrer (Dissolver) at 3,500 rpm over a period of 30 to 120 minutes to obtain a spectral sensitizing dye dispersion in a form of solid particle dispersion.

Various additives were added as follows.

Additives which were added to an emulsion (silver halide coating solution) are as follows. The addition amount was expressed in terms of mol per mol of silver halide.

| | |
|---|---|
| Compound N 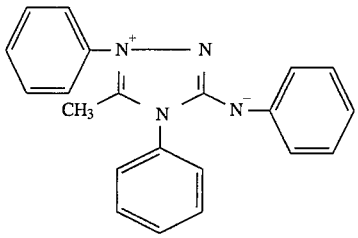 | 150 mg |
| t-Butylcathecol | 400 mg |
| Polyvinyl pyrrolidone (M.W. 10,000) | 1.0 g |
| Stylene-anhydrous maleic acid copolymer | 2.5 g |
| Trimethylol propane | 10 g |
| Diethylene glycol | 5 g |
| Nitrophenyl-triphenyl-phosphonium chloride | 50 mg |
| Ammonium 1,3-dihydroxybenzene-4-sulfonate | 4 g |
| Sodium 2-mercaptobenzimidazole-5-sulfonate | 1.5 mg |
| Compound S 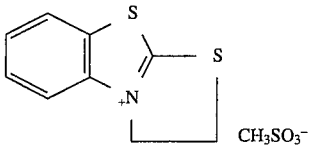 | 70 mg |
| $n\text{-}C_4H_9OCH_2CH(OH)CH_2N(CH_2COOH)_2$ | 1 g |

additives used in a protective layer coating solution were as follows. Amounts thereof were expressed in terms of per g of gelatin

| | |
|---|---|
| Silicon dioxide particles | 64 mg |
| Polymethylmethaacrylate paticles particles (area-average diameter of 7 μm) | 7 mg |
| Colloidal silica (average grain size, 0.013 μm) | 70 mg |
| 2,4-Dichloro-6-hydroxy-1,3,5-triazine sodium salt | 30 mg |
| $(CH_2{=}CHSO_2{-}CH_2{-})_2O$ | 36 mg |
| 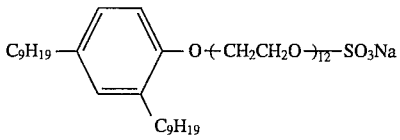 | 12 mg |

-continued

| | |
|---|---|
| $CH_2COO(CH_2)_9CH_3$<br>\|<br>$CHCOO(CH_2)_2CH(CH_3)_2$<br>\|<br>$SO_3Na$ | 7 mg |
| $NaO_3S-CH(CH_2COOCH_2(C_2F_4)_3H)-COOCH_2(C_2F_4)_3H$ | 3 mg |

An antistatic agent was added in an amount as shown in Table 1

The resulting samples were visually evaluated with respect to development evenness, based on the following five grades.

5: Excellent, 4: Good, 3: No problem in practical use, 2: Deteriorated, 1: Poorly deteriorated

TABLE 1

| Sample | Sensitizing dye | | Antistatic agent | | | Processing time | Surface resistance | Development unevenness | Remark |
|---|---|---|---|---|---|---|---|---|---|
| No. | Kind | Amount | Kind | Layer | Amount | (sec.) | (Ω/cm) | | |
| 1 | D-1 | 370 | — | — | — | 45 | no less than $10^{14}$ | 4 | Comp. |
| 2 | D-1 | 370 | A | PL* | 65 | 45 | $5 \times 10^{11}$ | 1 | Comp. |
| 3 | D-4 | 370 | A | PL* | 65 | 45 | $5 \times 10^{11}$ | 2 | Comp. |
| 4 | D-4 | 370 | B | PL* | 65 | 45 | $6 \times 10^{11}$ | 2 | Comp. |
| 5 | D-4 | 370 | C | PL* | 65 | 45 | $1 \times 10^{13}$ | 2 | Comp. |
| 6 | D-1 | 370 | P | IL* | 600 | 45 | $1 \times 10^{11}$ | 2 | Comp. |
| 7 | D-3 | 370 | P | IL* | 600 | 45 | $1 \times 10^{11}$ | 2 | Comp. |
| 8 | D-4 | 370 | P | IL* | 600 | 45 | $1 \times 10^{11}$ | 4 | Inv. |
| 9 | D-1 | 370 | S | IL* | 170 | 45 | $2 \times 10^{10}$ | 2 | Comp. |
| 10 | D-4 | 370 | S | IL* | 170 | 45 | $2 \times 10^{10}$ | 4 | Inv. |
| 11 | D-4 | 370 | I | IL* | 170 | 45 | $1.3 \times 10^{10}$ | 4 | Inv. |
| 12 | D-1 | 370 | A | PL* | 65 | 30 | $5 \times 10^{11}$ | 1 | Comp. |
| 13 | D-1 | 370 | P | IL* | 600 | 30 | $1 \times 10^{11}$ | 1 | Comp. |
| 14 | D-4 | 370 | P | IL* | 600 | 30 | $1 \times 10^{11}$ | 4 | Inv. |
| 15 | D-4 | 370 | S | IL* | 170 | 30 | $2 \times 10^{10}$ | 4 | Inv. |

*PL: Protective layer, IL: Interlayer
1) Addition amount of a sensitizing dye: mg/mol Ag
2) Addition amount of a antistatic agent: mg/m$^2$
3) Antistatic agent(s):
P: A water soluble polymer, hydrophobic polymer and reaction product of a hardener; addition amounts represents an amount of water soluble polymer P4
S, I: Metal oxide dispersed in gelatin of 0.1 g/m$^2$
S: $SnO_2/Sb_2O_3$, I: $In_2O_2/Sb_2O_3$
A, B, C: Comparative antistatic agent Coating solutions as above were each coated on both sides of a subbed and blue-colored polyethylene terephthalate film base having a thickness of 180 μm. Silver coverage, gelatin contents of a emulsion and protective layers were 1.8 g/m$^2$, 1.8 g/m2 and 1.0 g/m$^2$, respectively, which were each expressed in terms of an amount per one side. An interlayer described in Table 1 was provided between a subbing layer and an emulsion layer.

Samples were evaluated in the following manner and the results thereof were shown in Table 1.

Surface electric resistance:

A test piece of each sample was sandwitched with brass-made electrodes with 10 cm in length and 14 cm in electrode spacing, and a resistance thereof was measured with a insulation-meter produced by Takeda Riken Co., Type TR 8651 over a period of one minute. Samples, after being aged for two hours under a temperature of 25° C. and a relative humidity of 20%, were subjected to the measurement.

Development evenness:

Samples were each exposed uniformly to tungsten light so as to produce a density of 1.5 ±0.2, and processed with SRX-503 (product of Konica), in which 45 second mode was changed to 30 second mode (line-speed was increased by modification).

Inventive antistatic layer expressed in terms of "P" in the table contained compounds as below.

Water soluble polymer P4 — Amount (Table 1)

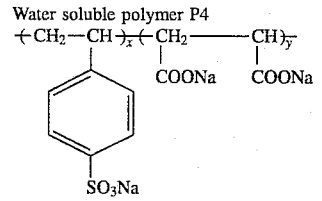

x:y = 65:35
$\overline{M} \approx 120{,}000$

Hydrophobic polymer HP1 — 0.5 g/m$^2$

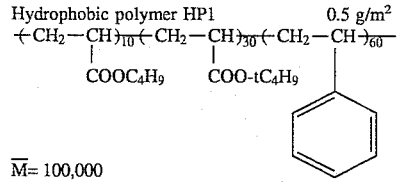

$\overline{M}$= 100,000

Hardener AH5 — $2 \times 10^{-3}$ mol/dm$^2$

-continued

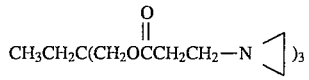

Comparative antistatic agent:

A: $C_{11}H_{23}CONH(CH_2CH_2O)_5H$

B: $C_{18}H_{37}\text{-}(CH_2CH_2O)_{15}\text{-}H$

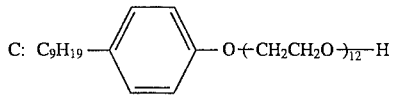

From the results in Table 1, samples containing an inventive silver halide emulsion were shown to be low in surface resistance and improved in development unevenness, even when rapid-processed.

EXAMPLE 2

Preparation of silver halide emulsion:

On monodisperse silver iodobromide nucleus grains having an average size of 0.2 μm and an average iodide content of 2.0 mol%, silver iodobromide containing 30 mol% iodide was further grown at the pH of 9.8 and the pAg of 7.8, thereafter, equimolar amounts of potassium bromide and silver nitrate were added thereto to form monodisperse silver iodobromide grains having an average iodide content of 2.2 mol% and an average size of 0.395 μm.

The emulsion formed was desalted by a coagulation method to remove excessive salts. Thus, a solution of a condensation product of formalin with naphthalene sulfonic acid sodium salt and a solution of magnesium sutfate were added to the emulsion to form coagulum. After removing the supernatant, water (40° C.) was added thereto to disperse the coagulum, and then the resultant emulsion was again coagulated by adding a magnesium sulfate solution to remove the supernatant.

Thus obtained silver halide grain emulsion was proved to be excellent in monodispersity having a monodispersity degree of 0.15.

Preparation of samples, and processing and evaluation thereof.

To the emulsion prepared as above, water was added to make a volume of 500 ml per mol of silver halide. After adjusted to 55° C., spectral sensitizing dyes I-1 and I-2 (200:1 by weight), which were dispersed in the same manner as in D-1 and D-4 of Example 1, were added to the emulsion in a total amount of 300 mg permol of silver halide. After 10 minutes, the emulsion was chemically sensitized by adding $2.6\times10^{31\ 3}$ mol/mol Ag of ammonium thiocyanate and optimal amounts of a chloroaurate and sodium thiosulfate.

During this time, the pH and silver potential were maintained at 6.15 and 50 mV, respectively.

At 15 minutes before the completion of the chemical sensitization (at 70 minutes after the start of the chemical sensitization), 200 mg/mol Ag of potassium iodide was added thereto. After 5 minutes, an acetic acid solution (10% wt./vol.) was addded to lower the pH to 5.6 and the pH was maintained further for 5 minutes as it was. Thereafter, the pH of the emulsion was increased to 6.15 by adding a potassium hydroxide solution (0.5% wt./vol.), then 4-hydroxy-6-methyl- 1,3,3*a*,7-tetrazaindene was added to stop the chemical sensitization and a photographic emulsion was obtained.

Thus obtained emulsion was found to have a pH of 6.10 and a silver potential of 81 mV at 35° C.

Using an emulsion coating solution and protective layer coating solution as shown below, photographic samples were prepared so that an emulsion layer was coated so as to have a gelatin content of 1.6 g/m$^2$ and a silver coverage of 3.0 g/m$^2$and a protective layer was coated thereon so as to have 0.9 g/m$^2$ of gelatin.

Spectral sensitizing dyes were added as shown in Table 2.

Antistatic layers on the emulsion layer-side and backing layer-side, as shown in Table 2, were coated in the same manner as in Example 1.

Additives used in the emulsion layer (silver halide emulsion coating solution) were as follows, provided that an addition amount was expressed in terms of the amount per mol of silver halide.

| | |
|---|---|
| 1,1-Dimethylol-1-brom-1-nitromethane | 70 mg |
| t-Butyl-catechol | 400 mg |
| polyvinyl pyrrolidone (M.W.: 10,000) | 1.0 g |
| Stylene-anhydrous maleic acid copolymer | 2.5 g |
| Trimethylol propane | 10 g |
| Diethylene glycol | 5 g |
| Nitrophenyl-triphenyl-phosphonium chloride | 50 mg |
| Ammonium 1,3-dihydroxybenzene-4-sulfonate | 4 g |
| Sodium 2-mercaptobenzimidazole-5-sulfonate | 1.5 mg |
| Compound N | 150 mg |
| Compound S | 70 mg |
| $n\text{-}C_4H_9OCH_2CH(OH)CH_2N(CH_2COOH)_2$ | 1 g |

Compounds N and S are the same as those of Example 1.

Additives used in the protective layer are as follows, provided that an addition amount was expressed in terms of an amount per liter of the coating solution.

| | |
|---|---|
| Lime-processed inert gelatin | 68 g |
| Acid-processed gelatin | 2 g |
| Polymethylacrylate (matte material having an area-averaged particle size of 3.5 μm) | 1.1 g |
| Silicon dioxide particles (matte material having an area-averaged size of 1.2 μm) | 0.5 g |
| Ludox AM (colloidal silica produced by du Pont) | 30 g |
| 2% solution of 2,4-Dichloro-6-hydroxy-1,3,5-triazine sodium salt | 12 ml |
| Sodium i-amyl-n-decylsulfosuccinate | 1.0 g |
| $C_8F_{17}SO_3K$ | 0.2 g |

Antistatic agent, as shown in Table 2

Backing layers were coated using the following compositions.

An interlayer as a antistatic layer, as shown in Table 2, was coated between a lower backing-layer and a subbing layer.

Backing layers were coated, having the following compositions which were expressed in an amount per liter of a coating solution.

| Lower backing-layer: | |
|---|---|
| Lime-processed gelatin | 70 g |
| Acid-processed gelatin | 5 g |
| Trimethylolpropane | 1.5 g |
| Backing dye A | 1.0 g |
| Backing dye B | 1.0 g |
| glyoxal (40%) | 8 ml |
| Upper backing-layer (Protective layer): (per liter of a coating solution) | |
| Lime-processed gelatin | 70 g |
| Acid-processed gelatin | 5 g |
| Trimethylolpropane | 1.5 g |
| Backing dye A | 2.0 g |
| Backing dye B | 2.0 g |
| $KNO_3$ | 0.5 g |

-continued

| | |
|---|---|
| 2% solution of 2,4-Dichloro-6-hydroxy-1,3,5-triazine sodium salt | 12 ml |
| Polymethylmethaacrylate particles having a area-averaged particle size of 4.0 μm | 1.1 g |
| Sodium diethylhexylsulfosuccinate | 0.4 g |
| Antistatic agent(s), as shown in Table 2 | |

Backing dye A

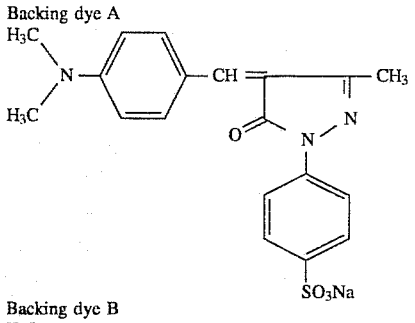

Backing dye B

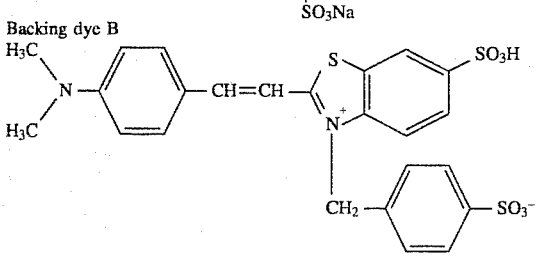

Lower and upper backing-layers were respectively coated so that gelatin coating amounts thereof were 1.6 and 0.9 g/m$^2$.

Thus-prepared samples were evaluated in the same manner as in Example 1, provided that static mark was visually observed to evaluate antistatic property. Results thereof are shown in Table 2.

Evaluation of static mark:

Samples were kept standing in an atmosphere of a temperature of 23° C. and a relative humidity of 20% over a period of one hour, thereafter, they were cut. into 6×30 cm pieces. As illustrated in FIG.1, a weight of 500 g was suspended on each piece which was subjected to friction with neoprene rubber rod of about 30 mm in diameter at a speed of one reciprocal cycle per about 0.8 seconds in the direction indicated by an arrow in a total of five cycles. Then, the piece, remaining unexposed, was processed using an automatic processor SRX-501 (product of Konica), and macroscopically observed for static marks. The antistatic property was evaluated in accodance with the following criteria.

5: Excellent, 4: Good, 3: No problem in practical use, 2: Deteriorated, 1: Poorly deteriorated.

TABLE 2

| Sample | Sensitizing dye | | Antistatic agent (EC*1) | | | Antistatic agent (BC*2) | | | Processing time | static | Development unevenness | |
|---|---|---|---|---|---|---|---|---|---|---|---|---|
| No. | Kind | Amount | Kind | Layer | Amount | Kind | Layer | Amount | (sec.) | marks | | Remark |
| 1 | D-1 | 370 | A | PL*3 | 65 | A | PL* | 65 | 30 | 4 | 1 | Comp. |
| 2 | D-4 | 370 | — | — | — | A | PL* | 65 | 30 | 1 | 3 | Comp. |
| 3 | D-4 | 370 | P | IL*4 | 600 | P | IL* | 600 | 30 | 5 | 4 | Inv. |
| 4 | D-4 | 370 | — | — | — | P | IL* | 600 | 30 | 3 | 4 | Comp. |
| 5 | D-4 | 370 | — | — | — | S | IL* | 170 | 30 | 4 | 4 | Comp. |

*1EC: Emulsion layer-coated side
*2BC: Backing layer-coated side
*3PL: Protective layer
*4IL: Interlayer As can be seen from the results of Table 2, it was proved that inventive samples were less in occurrence of static marks and improved in development unevenness, when subjected to rapid processing.

What is claimed is:

1. A silver halide photographic light-sensitive material comprising a support having thereon a silver halide emulsion layer containing a silver halide emulsion, wherein said support has, on at least one side thereof, an antistatic layer comprising a water-soluble conductive polymer and a hydrophobic polymer that has been hardened with a hardener, or an antistatic layer comprising conductive metal oxide particles containing at least one metal selected from Zn, Ti, Sn, Al, In, Si, Mg, Ba, Mo, W and V; said antistatic layer having thereon said silver halide emulsion layer; and said silver halide emulsion being spectrally sensitized by adding thereto a substantially water-insoluble spectral-sensitizing dye in the form of a dispersion of solid particles dispersed in an aqueous medium substantially free from an organic solvent and a surfactant.

2. The silver halide photographic material of claim 1, wherein said antistatic layer comprises conductive metal oxide particles selected from ZnO, $TiO_2$, $SnO_2$, $Al_2O_3$, $In_2O_3$, $SiO_2$, MgO, BaO, $MoO_3$ and $V_2O_3$.

3. The silver halide photographic material of claim 1, wherein said dye has a solubility in water of $2\times10^{-4}$ to $4\times10^{-2}$ mol/l at 27° C.

4. The silver halide photographic material of claim 1, wherein said dye is dispersed in water.

5. The silver halide photographic material of claim 1, wherein said solid particles of the dye have an average size of 1 μm or less.

6. The silver halide photographic material of claim 1, wherein said dispersion is prepared by a process comprising adding said dye into the aqueous medium substantially free from an organic solvent and surfactant, and dispersing said dye in the form of fine particles having an average size of 1 μm or less.

* * * * *